United States Patent [19]

Parzych

[11] 4,074,162

[45] Feb. 14, 1978

[54] BRUSH SPRING ASSEMBLY

[75] Inventor: Joseph F. Parzych, New Britain, Conn.

[73] Assignee: Dynamics Corporation of America, Greenwich, Conn.

[21] Appl. No.: 699,482

[22] Filed: June 24, 1976

[51] Int. Cl.[2] ..... H01R 39/40

[52] U.S. Cl. ..... 310/245

[58] Field of Search ..... 310/239, 240, 242, 245, 310/246, 247

[56] References Cited

U.S. PATENT DOCUMENTS

| | | | |
|---|---|---|---|
| 3,339,098 | 8/1967 | Burrows et al. | 310/247 X |
| 3,710,160 | 1/1973 | Voglesonger | 310/247 |
| 3,898,492 | 8/1975 | Vassos | 310/242 |
| 3,955,113 | 5/1976 | Hillyer | 310/245 |

*Primary Examiner*—Harold Tudor

*Attorney, Agent, or Firm*—Watson D. Harbaugh

[57] ABSTRACT

A brush spring and brush housing construction affording maximum operable brush wear without the danger of the brush spring contacting the commutator even if the brush might drop out of the housing. A hook on the brush end of the spring moves against an inclined wall of a tapered slot in the side of the housing and is directed to engage the end of the slot and be restrained from moving or twisting out of interlocking relation with the housing wall as well as being withheld from engagement with the commutator.

3 Claims, 8 Drawing Figures

BRUSH SPRING ASSEMBLY

BACKGROUND OF THE INVENTION

As more particularly discussed in the background considerations of the invention disclosed in the Vogelsonger U.S. Pat. No. 3,710,160, it is further highly desirable that a unitary brush spring have a length which provides a substantially constant firm conductive contact pressure without causing undue wear of an electrically conductive brush engaging the commutator in a universal fractional horsepower electric motor. For accomplishing these purposes, the springs are comparatively light and normally have a free length substantially exceeding the length of the brush holder and, if free to do so, would contact the commutator and not only be damaged but also cause other damage if and when the brush is worn down enough to drop out of position or make inadequate contact with the current carrying brush housing on the commutator.

Furthermore, the reduction of material and production costs and the ease and rapidity of assembly of the spring, brush and armature as a production time-saving consideration are of importance, including the installation of the brushes after the field and armature have been assembled.

In providing a new and improved graphite brush mounting assembly, the brush and spring are easily installed after the armature and brush carrier subassemblies have been mounted in the motor frame. Then, when the brushes are to be installed, they are inserted in place, followed by the springs which are then compressed and temporarily held in place while an end flap integrally formed with the brush housing is bent to hold the spring in compressed position in the brush housing.

A further object of the invention is to provide a simplified brush assembly which prevents the brush compression spring from coming into contact with the commutator after the brush has worn beyond its effectiveness or dropped out.

DESCRIPTION OF THE PREFERRED EMBODIMENT

Figure 1:
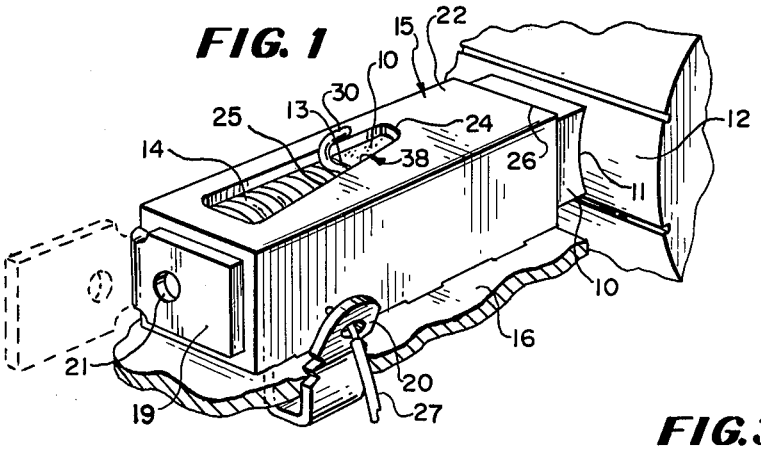
FIG. 1 is a perspective view of a brush assembly constructed in accordance with the invention.
Figure 2:
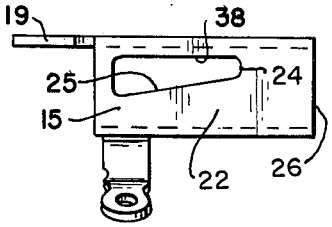
FIG. 2 is a top plan view of the brush housing prior to being mounted on the brush assembly mounting board.
Figure 3:
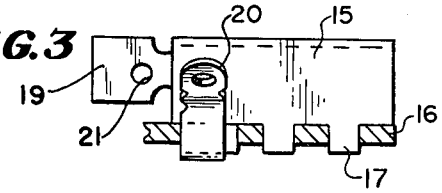
FIG. 3 is a side elevation of the brush housing as mounted on an assembly board.

Referring to FIGS. 1-5, 1 brush assembly is illustrated having a carbon brush 10 a substantially rectangular cross-section with a concave end face 11 adapted to engage a commutator 12, the latter comprising a part of the rotatable armature of an electric motor. The other end face 13 of brush 10 is preferably flat for engaging a helical compression spring 14. The compression spring 14 and brush 10 preferably have approximately the same cross-sectional overall dimensions and are slidably mounted in tandem within a brush housing 15, with the concave face 11 of the brush 10 extending out the forward end of the housing to engage the commutator 12. The housing 15 is mounted to an assembly board 16 as received by bent-over ears 17 (FIGS. 3 and 5) and forms a channel to maintain accurate alignment between the brush and the motor commutator. Several pairs of mounting tabs 17 struck from the bottom of housing 15 provide convenient and economical means for securing the housing to the insulated rush mounting board 16 of the type often used in small appliance motors. An electrical terminal formed by a tab 20 on the lower edge of the housing 15 is connected to a lead 27 which carries electrical current through the housing toe the brush 10.

A slot 38 is cut lengthwise in the wall 22 of the housing 15 extending lengthwise of the housing and preferably narrowing towards the commutator but ending at 24 a spaced distance from the end 26 of the wall 22 which in turn is spaced from the surface of the armature commutator 12 a fixed distance to support the brush against falling out when worn to its minimum length to which the brush would be permitted to be reduced by wear in use.

For the assembly of each brush in a brush housing, the brushes are slipped into the respective housings after the brush board 16 has been mounted in place. Each spring 14 is then inserted into the housing 15 and compressed to clear the open end 18 whereupon each flap 19 is moved from its dotted line position in FIG. 1 to its closed position shown in full lines in FIGS. 1 and 4 (see also FIGS. 2 and 3). For this purpose a hole 21 is provided in the flap 19 near its bend line to receive the short end of a bent rod tool (not shown) which when twisted closes the flap and flexes the flap hinge material to hold the flap closed.

The brush spring 14 that is received in the housing comprises a unitary spring wire member preferably of light gauge and formed to have a main coiled portion 29 of a normal length preferably in excess of the length of the housing 16, the slot 38 and an outrigger portion 30. The length of the coiled portion when compressed provides an adequate and acceptable uniform pressure between the brush 10 and commutator 12 for a predetermined wear length of the brush 13 which wear when attained in use located the spring end coil 28 outside of and just in front of the narrow end 24 of the brush of the slot 38.

By way of example and not limitation, twelve turns of 0.0179 inch silver coated beryllium copper alloy wire having ten active turns of 0.213 inch O.D. is treated to provide an 8 oz. effort at a 0.406 inch compressed length within a working space slightly less than 0.75 inch.

The spring 14 is coiled cylindrically to be guided by the walls of the brush housing, including particularly wall 22, with the flat end coil 28 bearing against the brush and terminating laterally in an outrigger portion which may be referred to as a hook 30 comprising a lateral extension of the wire stock at its brush contacting end 13 that extends outwardly through the slot 38 and is terminally curved reversely and then forwardly to provide the hook-like portion 30 opening towards the commutator 12 at the narrow end 24 of the slot 38. The hook-like portion 30 holds the brush engaging end coil 28 normal to the axis of brush movement and if that coil tends to buckle forward when the brush 10 is not there the hook portion is shaped to still engage the narrow end of the slot and hold the coil against moving into contact with the commutator 12.

In the preferred form, the hook ends are located outside the major cylindrical surface of revolution defined by the spring coils 14 and one end 32 is integrally connected by a portion 34 of wire extending tangentially to the end coil 28 that engages the brush 10. This portion 34 of wire extends outside the surface of revolution of the coils and could abut against an end edge of a conventional slot and thereby interfere with the hook telescoping over the end edge and thus would interfere with proper brush pressure upon the commutator, unless that section of wire is lowered below the level of the edge of the slot.

Figure 4:
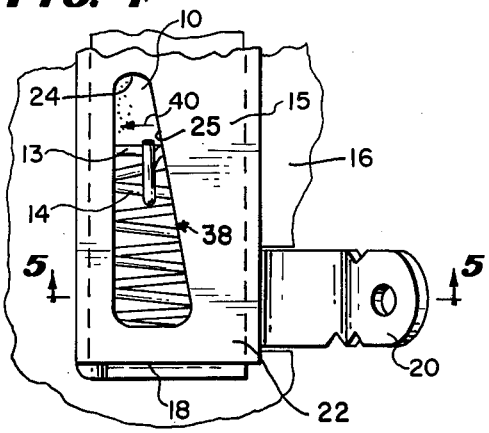
FIG. 4 is an enlarged plan view of longitudinal slot in the brush housing showing the movement of the hook end on the spring received therein.
Figure 6:
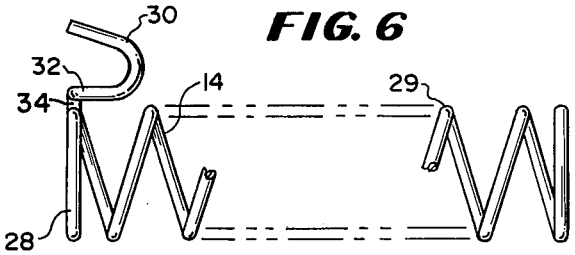
FIG. 6 is a side view showing the construction at the brush end thereof.
Figure 5:
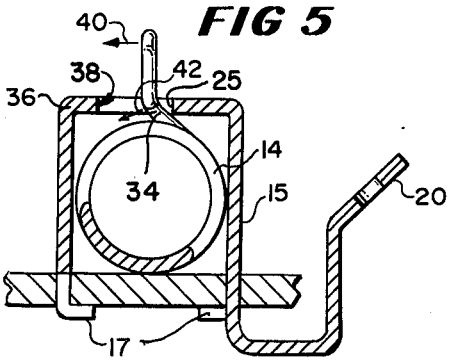
FIG. 5 is a cross-sectional view taken on line 5—5 in FIG. 4.
Figure 7:
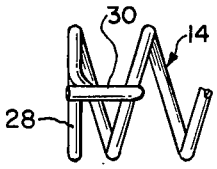
FIG. 7 is a top plan view of the brush end of the spring.
Figure 8:
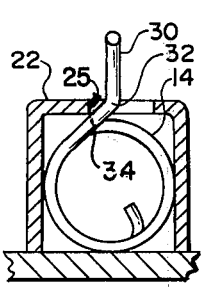
FIG. 8 is an end view of the brush end of the spring shown in FIG. 7.

By way of lowering the portion 34 to avoid the interference mentioned, the slot 38 is located preferably off-center of the center line of the rectangular side 22 of the brush housing as much as can be permitted production-wise in view of the proximity of the corner bend 36 (FIG. 5) of the housing and the side of the slot 38 proximate thereto. The side 25 of the slot 38 that is proximate to the centerline of the wall 22 is inclined with respect to the bend 36 (FIG. 4). Thereby, as the hook moves forward with brush wear and vibration over a period of long use, the tangential wire section 34 is disposed in sliding engagement with the inclined edge 25 and this edge operates to cam or turn the hook in the direction of the arrow 40 (FIG. 4) to a position where the inner end 32 of the hook is moved laterally and inwardly of the housing wall 22 into the space indicated by arrow 42 (FIG. 5). Then, when it reaches a certain advancement, the hook will span and engage the end wall 24 at the end of the slot 38.

The winding of the brush spring in the form shown can be accomplished at minimal cost, the hook is provided and operates as desired, and the relationship permits the use of the brush with a determined maximum permissible wear. Then when the brush requires replacement as evidenced by brush vibration varying the limited remaining commutator contact pressure, which vibration produces an intermittency or wavering in motor operation, a bent pin wrench (not shown) is again inserted in the hole 21, the flap 18 opened; the spring 14 removed; the worn brush removed and replaced; the spring is restored; and, the flap 18 again moved to its closed position.

Not only does the outrigger hook 30 engaging the end 24 of the slot 38 prevent the spring 14 contacting the commutator 12 but it provides a projecting element which can be contacted by a person's finger or tool and retracted to compress the brush spring to receive the brush far enough to clear the commutator during the assembly of the motor commutator in the motor frame if brush repair or replacement, which is minimal, is accomplished by armature removal procedures. A new brush is not obstructed by a brush spring extending beyond the brush housing as in conventional constructions when a brush is being replaced.

What is claimed is:

1. In an electric motor having a commutator brush assembly comprising:

an elongated brush housing having a longitudinal slot in one rectangular side wall, said slot having a longitudinal side edge inclined as a cam to the longitudinal center line of said side wall;

brush means slidably received in said housing;

a coiled brush spring having an end coil portion to engage the brush and a hook portion extending laterally from the side edge and overlapping the end of the coil and opening towards the brush; and means interconnecting one side of the hook and the end coil and disposed to engage said inclined edge for it to move the hook progressively into coincidence with the end of said slot as it progresses along said edge with brush wear.

2. The brush assembly defined in claim 1 in which said spring coils, hook and connector constitute a single integral spring wire.

3. In an electric motor having a commutator and brush assembly comprising;

an elongated brush housing having a longitudinal slot in one side wall defining a longitudinal side edge inclined as a cam to a longitudinal side edge and terminating in a cross wall having its inner edge spaced a substantial distance from the open end thereof;

an elongated carbon brush slidably mounted within said housing and adapted to extend beneath the cross wall and be retained in place thereby during its effective life;

means for urging said brush freely out one end of the housing into electrical contact with said commutator including a circular coiled wire spring having a wire end portion extending outwardly through said slot at a right angle to said cross wall and defining a hook that opens towards said commutator having a mouth substantially coextensive with the end coil that engages the brush for receiving the cross wall therein at the end of the slot proximate said commutator; and said slot defining a cam engaging said hook for partially turning said coil end and hook to a position in which the hook is inclined to the plane of said side wall to receive said edge.

* * * * *